US009644505B2

(12) United States Patent
Lawes et al.

(10) Patent No.: US 9,644,505 B2
(45) Date of Patent: May 9, 2017

(54) ROTARY VALVE INTERNAL COMBUSTION ENGINE

(71) Applicant: RCV ENGINES LIMITED, Wimborne, Dorset (GB)

(72) Inventors: Keith Lawes, Wimborne (GB); Brian Mason, Wimborne (GB)

(73) Assignee: RCV ENGINES LIMITED, Wimborne, Dorset (GB)

( * ) Notice: Subject to any disclaimer, the term of this patent is extended or adjusted under 35 U.S.C. 154(b) by 353 days.

(21) Appl. No.: 14/348,234

(22) PCT Filed: Oct. 5, 2012

(86) PCT No.: PCT/GB2012/052471
§ 371 (c)(1),
(2) Date: Mar. 28, 2014

(87) PCT Pub. No.: WO2013/050776
PCT Pub. Date: Apr. 11, 2013

(65) Prior Publication Data

US 2014/0366818 A1 Dec. 18, 2014

(30) Foreign Application Priority Data

Oct. 6, 2011 (GB) ..... 1117259.0

(51) Int. Cl.
*F01L 7/02* (2006.01)
*F01L 7/18* (2006.01)
*F01L 7/16* (2006.01)

(52) U.S. Cl.
CPC ..... *F01L 7/18* (2013.01); *F01L 7/021* (2013.01); *F01L 7/024* (2013.01); *F01L 7/16* (2013.01); *F02B 2275/22* (2013.01)

(58) Field of Classification Search
CPC ..... F01L 7/00; F01L 7/02; F01L 7/021; F01L 7/022; F01L 7/023; F01L 7/024; F01L 7/025; F01L 7/12; F01L 7/16; F01L 7/18
See application file for complete search history.

(56) References Cited

U.S. PATENT DOCUMENTS 1,156,663 A * 10/1915 Calkins ..... F01L 7/02 123/190.17
1,186,848 A * 6/1916 Schofield ..... F01L 7/16 123/190.8

(Continued)

FOREIGN PATENT DOCUMENTS

DE 4040936 A1 6/1992
DE 4217608 A1 4/1993

(Continued)

OTHER PUBLICATIONS

International Search Report and Written Opinion, mailed Apr. 5, 2013, for International Patent Application No. PCT/GB2012/052471.

*Primary Examiner* — Jacob Amick
(74) *Attorney, Agent, or Firm* — Thomas & Karceski, PC

(57) ABSTRACT

A rotary valve internal combustion engine has a piston connected to a crankshaft and reciprocatable in a cylinder, a combustion chamber being defined in part by the piston. The engine has a rotary valve rotatable in a valve housing fixed relative to the cylinder, the rotary valve having a valve body containing a volume defining, in part, the combustion chamber and further having a wall part thereof a port giving, during rotation of the valve, fluid communication successively to and from the combustion chamber via inlet and exhaust ports in the valve housing, wherein the rotary valve is rotatable about an axis parallel to the axis of rotation of the crankshaft, the valve being mounted in a bearing arrange- (Continued)

ment which restrains the valve from movement in the axial direction but permits movement in the radial direction.

6 Claims, 10 Drawing Sheets

(56) References Cited

U.S. PATENT DOCUMENTS

| | | | | | |
|---|---|---|---|---|---|
| 3,906,922 | A | | 9/1975 | Dane, Jr. | |
| 4,074,617 | A | * | 2/1978 | Cockcroft | F02F 3/047 92/228 |
| 4,773,364 | A | * | 9/1988 | Hansen | F01L 7/028 123/190.17 |
| 4,776,306 | A | * | 10/1988 | Matsuura | F01L 7/00 123/190.2 |
| 5,495,907 | A | * | 3/1996 | Data | B60K 6/365 180/65.245 |
| 6,321,699 | B1 | * | 11/2001 | Britton | F01L 7/022 123/188.9 |
| 2008/0276897 | A1 | * | 11/2008 | Petridis | F02D 41/3041 123/192.2 |

FOREIGN PATENT DOCUMENTS

| | | | |
|---|---|---|---|
| EP | 0194041 | A1 | 9/1986 |
| FR | 418427 | A | 12/1910 |
| GB | 28797 | | 2/1910 |
| GB | 118244 | | 8/1918 |
| GB | 2457947 | A | 8/2010 |
| WO | WO 9710417 | | 3/1997 |

* cited by examiner

ROTARY VALVE INTERNAL COMBUSTION ENGINE

CROSS-REFERENCE TO RELATED APPLICATION(S)

This is a National Stage Entry into the United States Patent and Trademark Office from International PCT Patent Application No. PCT/GB2012/052471, having an international filing date of Oct. 5, 2012, which claims priority to GB 1117259.0, filed Oct. 6, 2011, the entire contents of both of which are incorporated herein by reference.

FIELD OF THE INVENTION

The present invention relates to internal combustion engines in which the control of the intake and exhaust of combustion gases is achieved by means of a rotary valve.

DESCRIPTION OF THE RELATED ART

Such rotary valves are known, for example in the applicant's co-pending application No. GB 2467947A. Rotary valve engines are known to have problems of sealing as there is a conflict between minimising the clearances between the relatively rotating bodies, which improves efficiency, but runs the increasing risk of overheating and seizing. Attempts have been made for many years to make a commercially acceptable engine utilising rotary valves, notably by Aspin, but these have mostly been unsuccessful. In the prior art, such as DE 4217608 A1 and DE 4040936 A1, this conflict is recognised and attempts to solve the problem are made by providing complex cooling arrangements or simply saying the problem is solved by using suitable materials. In practice, larger than desired clearances are provided to reduce the risk of seizing, at the cost of reducing the efficiency of the engine and increased emissions.

SUMMARY OF THE INVENTION

The present invention seeks to provide an improved internal combustion engine of light weight and low cost by utilising the inherent simplicity of a rotary valve.

According to one aspect of the present invention there is provided a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the rotary valve is rotatable about an axis parallel to the axis of rotation of the crankshaft, in which the volume in the rotary valve body leads to a passageway, the passageway directing the flow of combustion gases between the volume in the valve and the cylinder, the passageway also defining, in part, the combustion chamber.

According to a second aspect of the invention there is provided a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the valve is mounted in a bearing arrangement which restrains the valve from movement in the axial direction but permits movement in the radial direction.

According to another aspect of the invention there is provided a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the inlet and exhaust ports are substantially parallel, the ports being on opposite sides of the valve housing and being positioned and sized to provide the required valve timing.

According to yet another aspect of the invention there is provided a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, the base material of the valve housing being aluminium.

The present invention also provides a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the rotary valve is rotatable about an axis parallel to the axis of rotation of the crankshaft, in which the volume in the rotary valve body leads to a passageway, the passageway directing the flow of combustion gases between the volume in the valve and the cylinder, the passageway also defining, in part, the combustion chamber, wherein the valve is mounted in a bearing arrangement which restrains the valve from movement in the axial direction but permits movement in the radial direction, wherein the inlet and exhaust ports are substantially parallel, the ports being on opposite sides of the valve housing and being positioned and sized to provide the required valve timing, the base material of the valve housing being aluminium.

The present invention further provides a rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the valve body has an annular part cylindrical sealing sleeve secured to the body for rotation therewith but movable radially relative to the body and being arranged such that combustion gases enter between the body and the seal to urge the seal into engagement with the valve housing.

In a preferred embodiment, the passageway is a substantially wedge-shaped volume inclined relative to the axis of the valve towards the cylinder. Preferably, the upper surface of the passageway is at an angle of between 30 and 60 degrees from the axis of rotation of the valve. Preferably, the passageway has a curved upper surface, adjacent the valve the upper surface being at a more acute angle to the axis of the valve, adjacent to the cylinder the upper surface being at a more obtuse angle relative to the axis of rotation of the valve.

When the engine is a spark ignition engine, the spark plug is preferably located in the upper surface of the passageway and may be located adjacent the region where the passageway meets the volume in the rotatable valve.

Preferably, a squish area is provided between the piston and the cylinder head on the side of the cylinder opposite the rotary valve.

The part of the valve body containing the volume defining the combustion chamber may lie radially inwardly of the circumference of the cylinder to overlie the piston. In this way, different improved combustion chamber shapes can be provided.

Preferably, the rotary valve is driven from the crankshaft by means of an endless belt or chain lying in a single plane. In a preferred embodiment, the endless belt comprises a toothed belt, wherein the drive to the valve is transmitted through a pair of toothed pulleys comprising a drive pulley on the crankshaft and a driven pulley secured to the valve, the driven pulley being secured to the valve on its side remote from the combustion chamber.

In a preferred embodiment, the axis of rotation of the valve passes through the axis of the cylinder, but in an alternative embodiment is offset from the cylinder axis.

In a preferred embodiment, the engine includes a contra rotating balance shaft also driven by said endless belt, which belt comprises a double toothed endless belt having teeth on both its opposed inner and outer surfaces, the crank pulley and balance shaft pulley engaging on teeth on opposite sides of the belt thereby driving the balance shaft in the opposite direction.

In a preferred embodiment the engine includes twin contra rotating balance shafts both driven by said endless belt, the crank pulley and balance shaft pulleys engaging on teeth on opposite sides of the belt thereby driving the balance shafts in the opposite direction, the balance shafts being arranged substantially equidistantly on either side of the crankshaft such the centre of mass of the offset balance weights is in line with the axis of the cylinder, thereby ensuring that the net balancing force generated by the balance shafts is in line with the reciprocating force generated by the piston. This eliminates any moment arm between the piston and balancer forces, thus minimising vibration at the engine mounting points.

In a preferred embodiment of the engine, contra rotating flywheels are incorporated on the balance shafts, the total rotational inertia of the contra rotating flywheels being substantially the same as the total rotational inertia of the engine crank drive train and flywheel. This minimises the torque recoil forces that appear at the engine mounting points. Torque recoil forces occur due to the compression and power forces on each firing, and also occur when the engine is accelerated or decelerated.

BRIEF DESCRIPTION OF THE DRAWINGS

Preferred embodiments of the present invention will now be described by way of example with reference to the accompanying drawings, in which.

DETAILED DESCRIPTION OF EMBODIMENT(S) OF THE INVENTION

Figure 1:
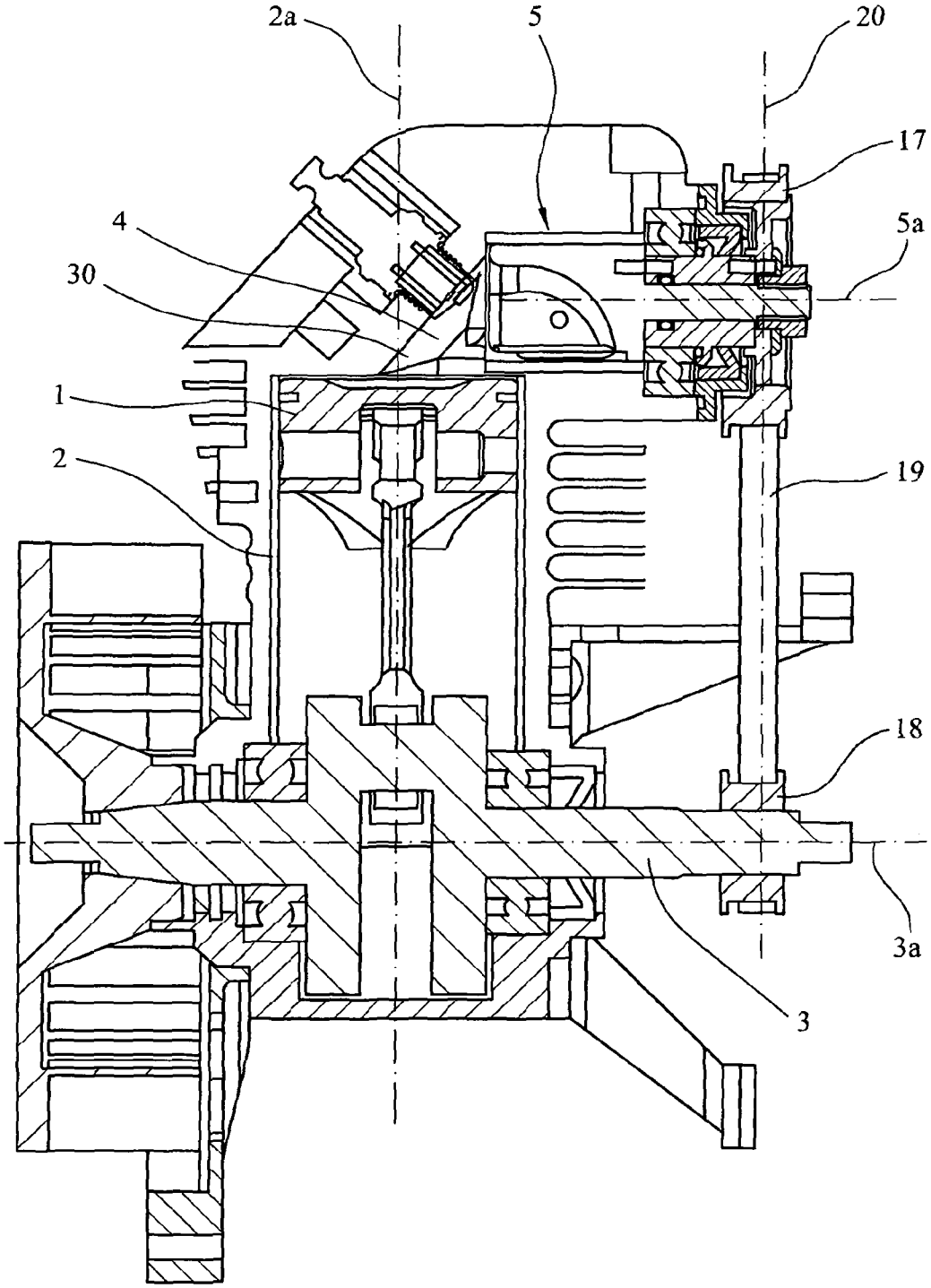
FIG. 1 shows a cross-sectional view of a single cylinder air cooled engine.

Referring now to FIG. 1, there is shown a single cylinder air cooled engine. The cylinder 2 has a piston 1 connected to a crankshaft 3 in the conventional manner for reciprocation in the cylinder 2. As shown particularly in FIG. 2, the upper part of the cylinder 2 is closed by a combustion chamber 4. The flow of inlet air/fuel mix and exhaust gas into and out of the combustion chamber 4 is controlled by a rotary valve 5, shown in cross-section in FIG. 2. In this embodiment, the valve is rotatable in a valve housing in the combustion chamber housing about an axis 5*a* which is parallel to the axis of rotation 3*a* of the crankshaft 3.

At its end remote from the combustion chamber 4, the rotary valve 5 has a driven pulley 17 mounted thereon which is connected to a drive pulley 18 on the engine crankshaft 3 by a belt drive arrangement, comprising an endless belt 19 having a toothed profile on its inner surface which drivingly engage with corresponding teeth on the pulleys 17 and 18. The pulleys, and hence the endless belt 19 also, lie in a common plane 20. Thus, the rotation of the crankshaft 3 and hence the piston movement is coordinated with the rotation of the rotary valve 5 so that the engine operates on the conventional four stroke cycle. To achieve this, the diameter of the driven pulley 17 is twice that of the drive pulley 18 so that the rotary valve 5 rotates at half engine speed.

Figure 2:
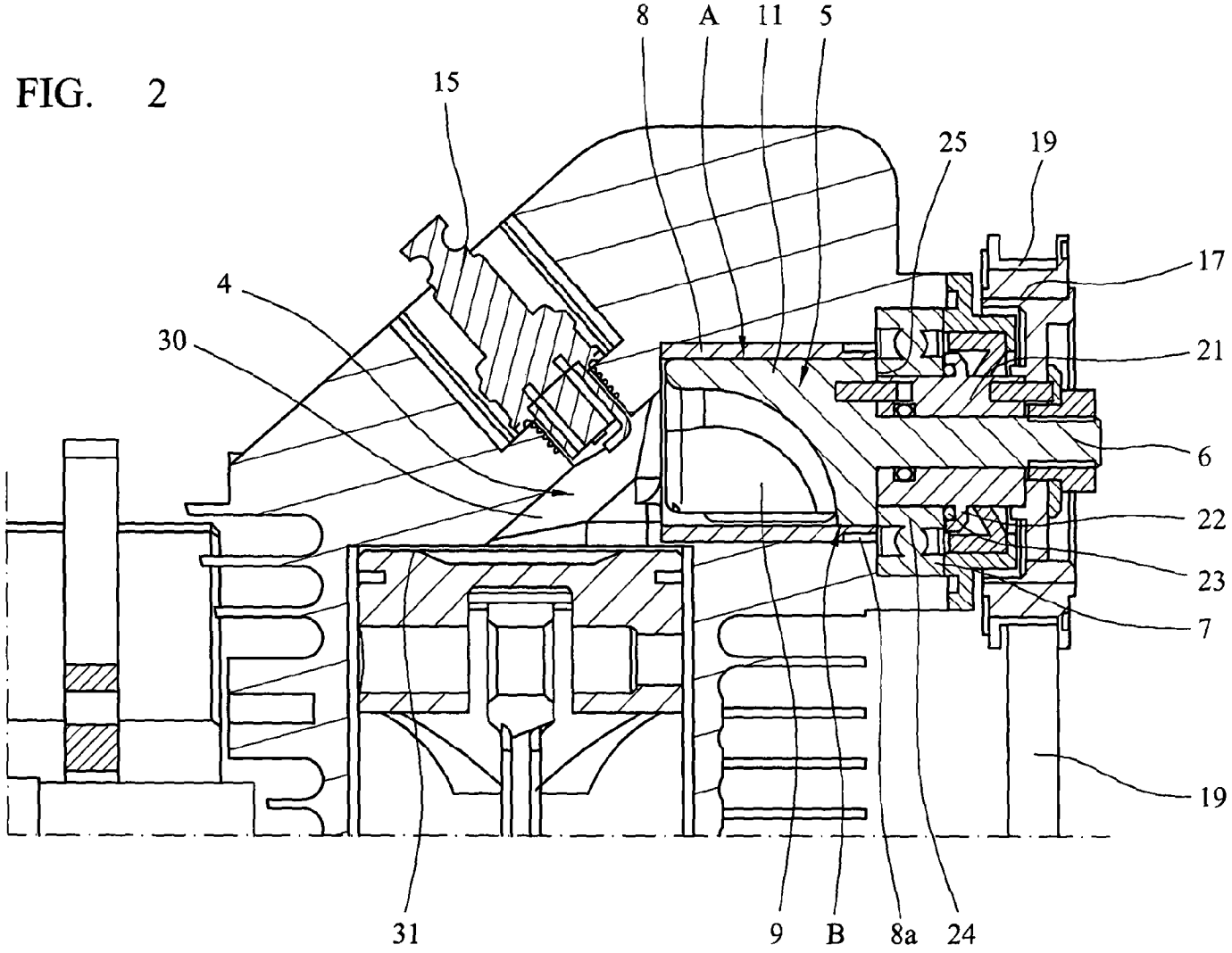
FIG. 2 is shown as a cross-sectional view of the engine of FIG. 1 showing further details of the rotary valve.

Referring now to FIG. 2 also, there is shown more detail of the rotary valve 5. The rotary valve consists of a plain active valve having a first cylindrical part in the form of a shaft 6 mounted on a ball bearing arrangement 7 in the form of a single race ball bearing, located on a side of the valve 5 remote from the combustion chamber 4. The valve has a larger cylindrical body part 11 extending into the combustion chamber and having in its interior a volume 9 which forms part of the combustion chamber 4. The cylindrical part 11 is rotatable in a bore in a valve housing insert 8 in which the cylindrical part 11 of the valve 5 is a close sliding fit, with only a minimum clearance of a few microns provided between the rotary valve 5 and the bore of the valve housing insert 8. The insert 8 in the valve housing is formed of a bearing material such as phosphor bronze or similar copper-based alloy with a high tin content. Alternatively, the insert may be formed of an aluminium alloy with good heat dissipation properties with a hard coating such as anodised aluminium, a ceramic or silicon carbide coating such as Nikasil (a registered trademark). Alternatively the hard coating material may be applied directly to the material of the cylinder body.

The shaft 6 has an insert or sleeve 21 secured for rotation with the shaft 6 and contains on its outer periphery a flange 22 having an axially extending peripheral rib 23. A shoulder 25 is formed between the larger diameter part 11 of the rotary valve and the shaft 6 and this shoulder 25 abuts the inner race 24 of the bearing 7 in the assembled condition to prevent the valve from moving in the axial direction away from the cylinder when the combustion chamber pressure is positive. There is a clearance between the peripheral rib 23 and the inner race 24 of the bearing 7. Resilient means in the form of an O-ring 43 or wave washer is located in the peripheral groove formed by the flange 22 and rib 23 and this serves to hold the valve axially when a negative pressure is formed in the combustion chamber during the induction stroke and serves to prevent the valve oscillating axially in this situation when the combustion chamber pressure acting on the valve varies from negative to positive and vice versa.

An annular gap is formed between the inner race 24 of the bearing and the periphery of the sleeve 21 to enable the rotary valve 5 to move radially in response to combustion gas pressure. There is a significant radial clearance between the sleeve 21 and the inner race 24 of the bearing which permits a degree of radial movement of the rotary valve. The rotary valve 5 has in its interior a volume 9, as illustrated in FIG. 2 and particularly FIGS. 4A and 4C, which forms part of the combustion chamber 4. The combustion chamber 4 consists of a closed part-hemispherical upper end in the volume 9 and an inclined wedge-shaped passage 30 forming an inclined passage which leads to the piston and the cylinder and which in cross-section is like a Norman arch as can be seen in FIGS. 5A and 5B. The wedge shaped passage 30 leads to the cylinder cavity. In the cylinder cavity there is a squish area 31 between the piston and the combustion chamber housing 32. The size and shape of the passage in the wedge shape part 30 is designed both to give the required compression ratio and also as a passage with good flow characteristics to allow for efficient gas transfer between the ports 13, 14 and the cylinder volume during the inlet and exhaust phases of the four stroke cycle. During the compression stroke the air fuel mixture is forced past the sparking plug towards the valve to ensure maximum combustion efficiency when ignition occurs. In an alternative design (not shown) the top of the piston is shaped to protrude into the wedge shaped chamber to provide the required compression ratio.

As shown, the wall part 11 of the rotary valve has a port 12 (see also FIGS. 4A and 4C) giving fluid access to and from the combustion chamber 4 through inlet and exhaust ports 13, 14 in the valve housing 8, illustrated particularly in the schematic cross-sections of FIGS. 5A and 5B. The drawings also illustrate a spark plug 15. The rotary valve body is formed of a steel, such as EN40B, which has been plasma nitrided and then ground into its final size, before being provided with a PVD coating such as a DLC (Diamond like Carbon) coating or a PVD ceramic coating. The inlet and exhaust ports 13, 14 are located on opposite sides of the engine with their longitudinal axes parallel, as is advantageous in most circumstances. As shown in FIG. 5A, where the ports are located adjacent to the upper part of the rotary valve on the opposite side to the crankshaft, and the rotary valve is rotating in the direction shown, the inlet port 13 is located on the right-hand side and the exhaust port 14 is located on the left-hand side. Depending upon the installation and direction of rotation requirements, it is possible for the ports to be located on the lower part of the rotary valve, that is between the axis of the valve and the crankshaft, in which case given that the rotary valve is rotating in the direction shown the inlet port 13 is on the left-hand side and the exhaust port 14 on the right, as shown in FIG. 5B.

In operation, at maximum combustion pressure, combustion gases tend to leak through the path A between the rotary valve body 11 and its seat 8 into the inlet and outlet ports 13, 14 giving an adverse effect on performance. This embodiment of the invention seeks to reduce the leakage along path A by permitting a slight radial movement of the rotary valve, permitted by the clearance between the insert 21 and the inner race 24 of the bearing so that at maximum combustion chamber pressure the valve moves radially and thus substantially closes the path A. The fact that the valve contacts the housing only at one particular part of the combustion cycle and the fact that it can move away from the housing slightly if it overheats, means that the known problem of seizing due to localised overheating is overcome.

In operation, at maximum combustion pressure, combustion gases also tend to leak through the path B between the valve body 11 and its housing 8 into the cavity containing the bearing 7. This embodiment of the invention seeks to reduce the leakage along path B by providing a ring of steel 8*a*, or other material with a low coefficient of expansion, embedded within the valve housing insert. This controls the thermal expansion of this region of the valve reducing the leakage path. This area of the valve is removed from the main area of combustion and runs at significantly lower temperatures, hence tighter clearances can be run without any risk of seizure.

Figure 3A:
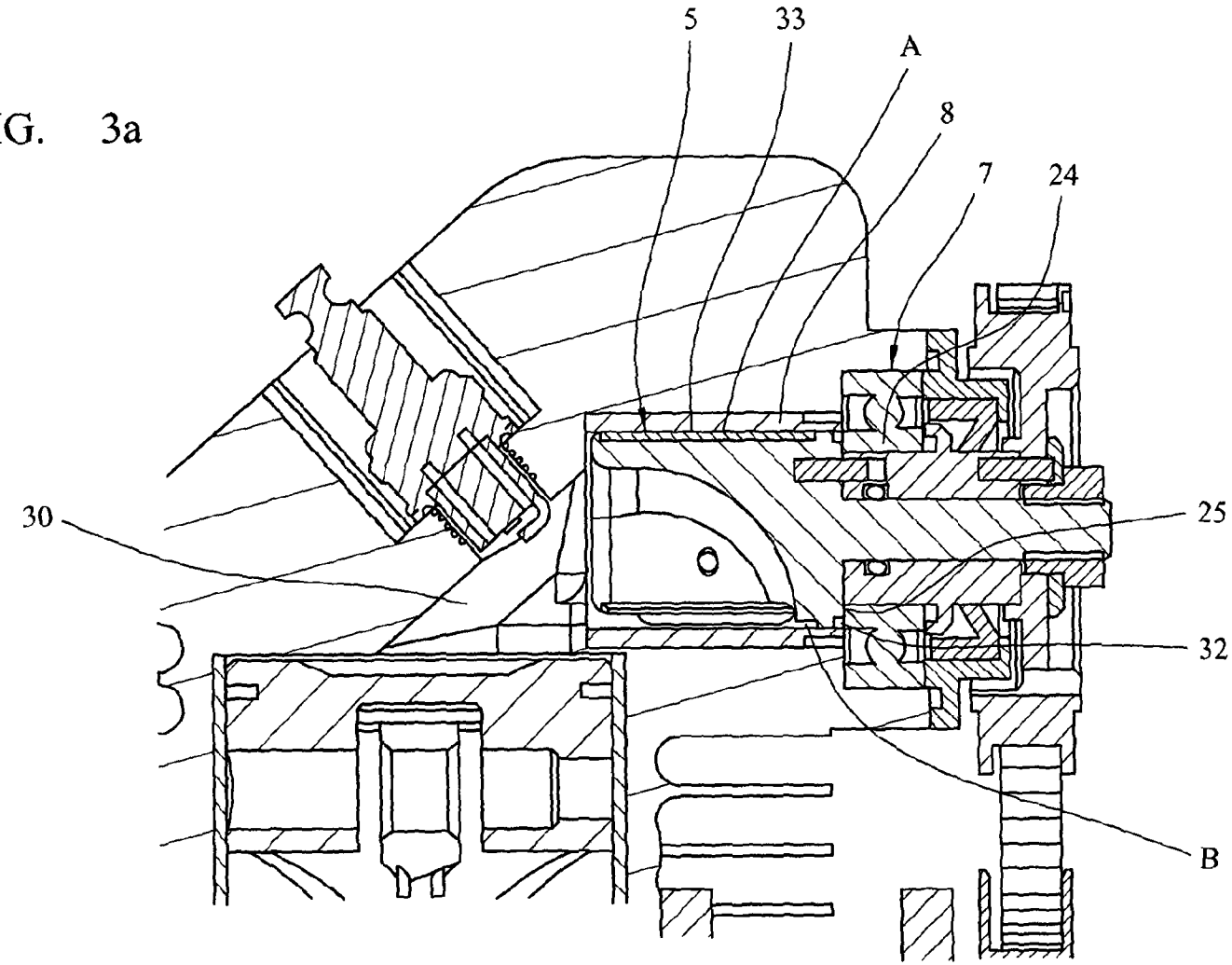
FIGS. 3A and 3B show cross-sectional views of two embodiments of the rotary valve having different sealing arrangements.
Figure 3B:
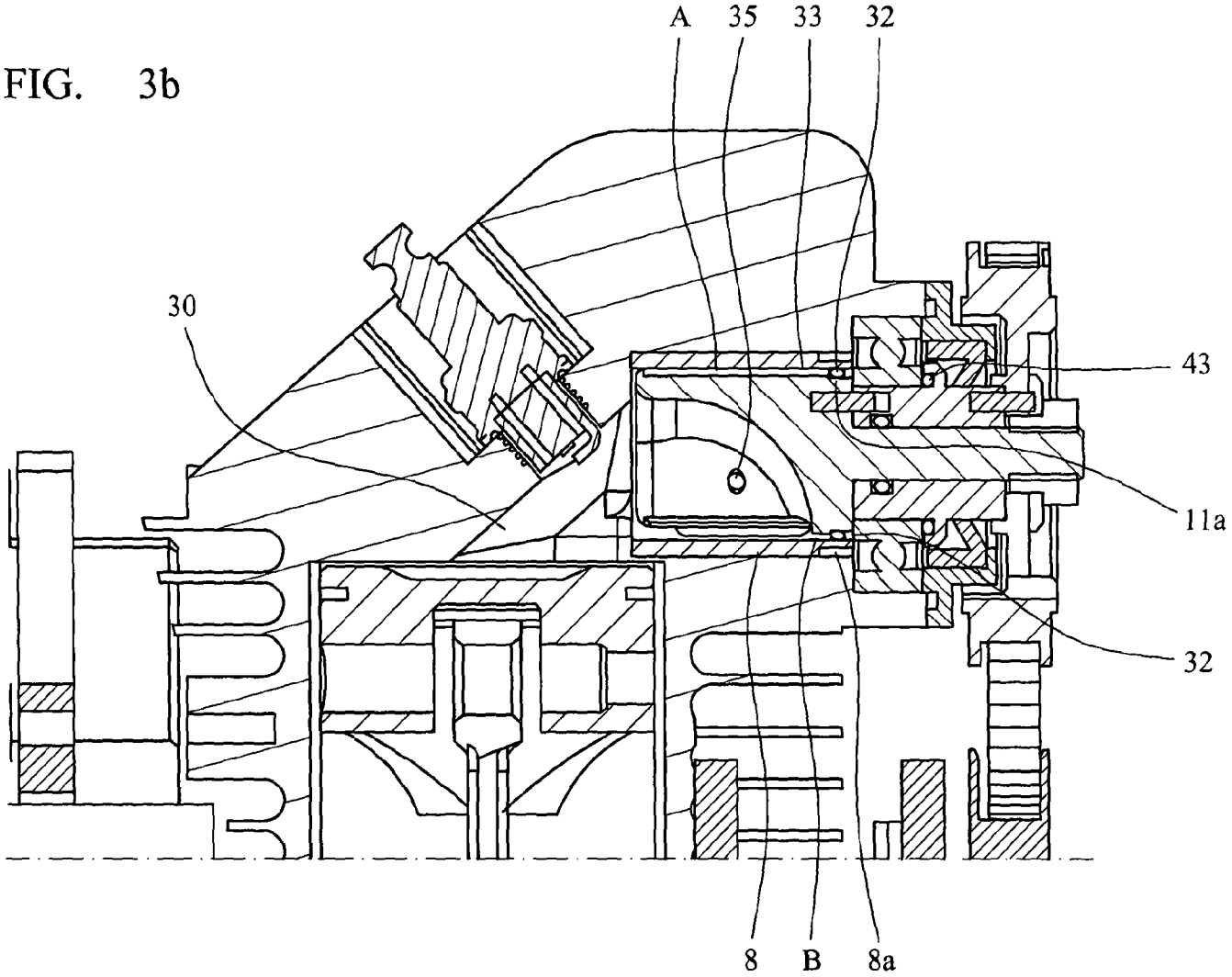
Figure 4A:
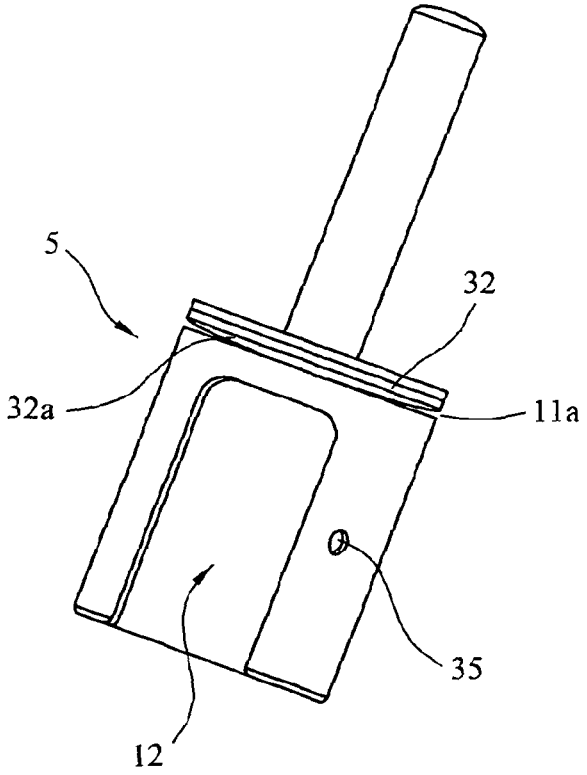
FIGS. 4A, 4B and 4C show details of the embodiments of the rotary valve shown in FIGS. 3A and 3B, FIGS. 5A and 5B show, schematically, alternative arrangements of the inlet and exhaust ports of the engine of FIG. 1.
Figure 4B:
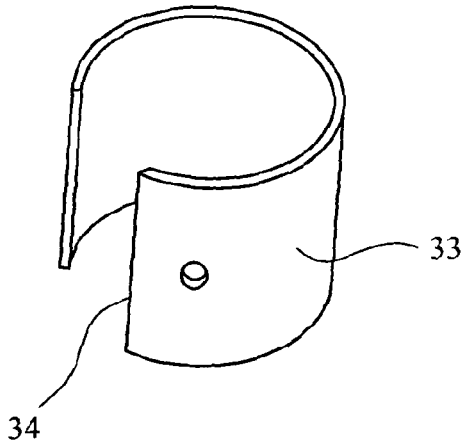
Figure 4C:
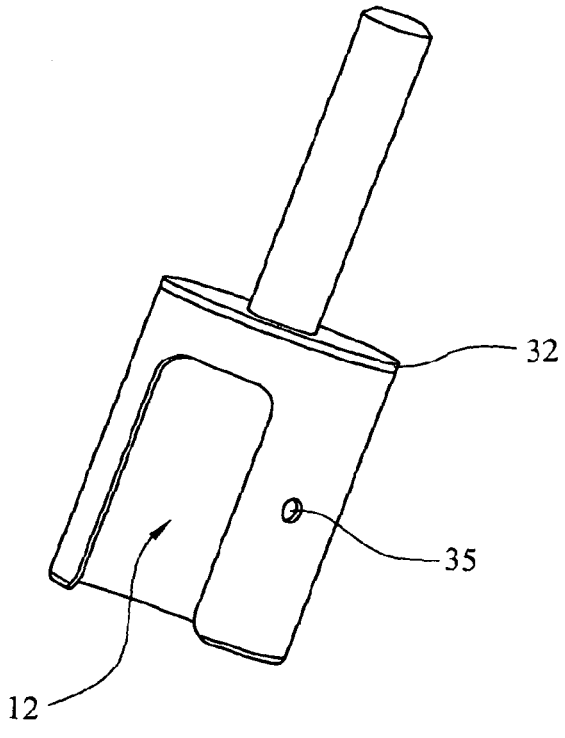
Figure 5A:
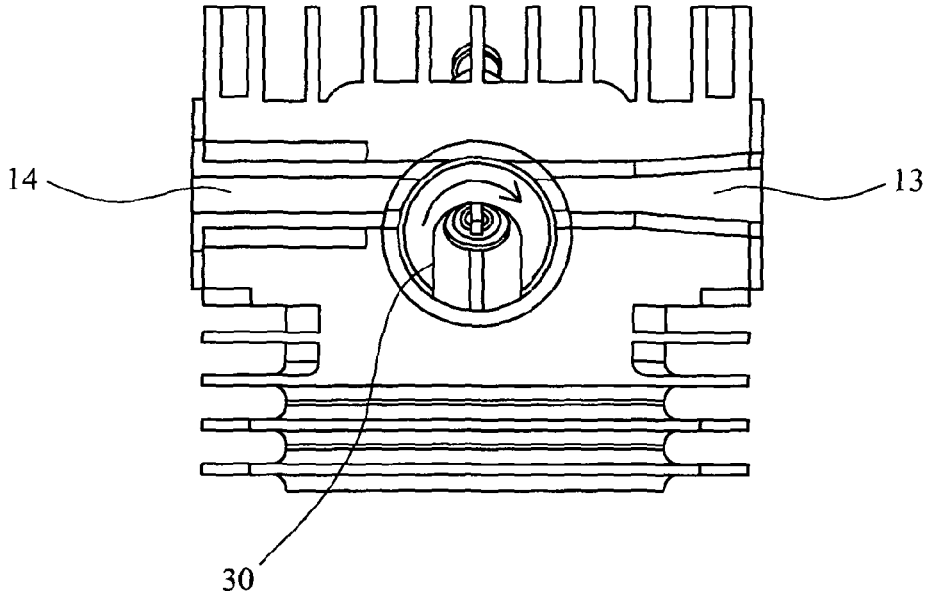
Figure 5B:
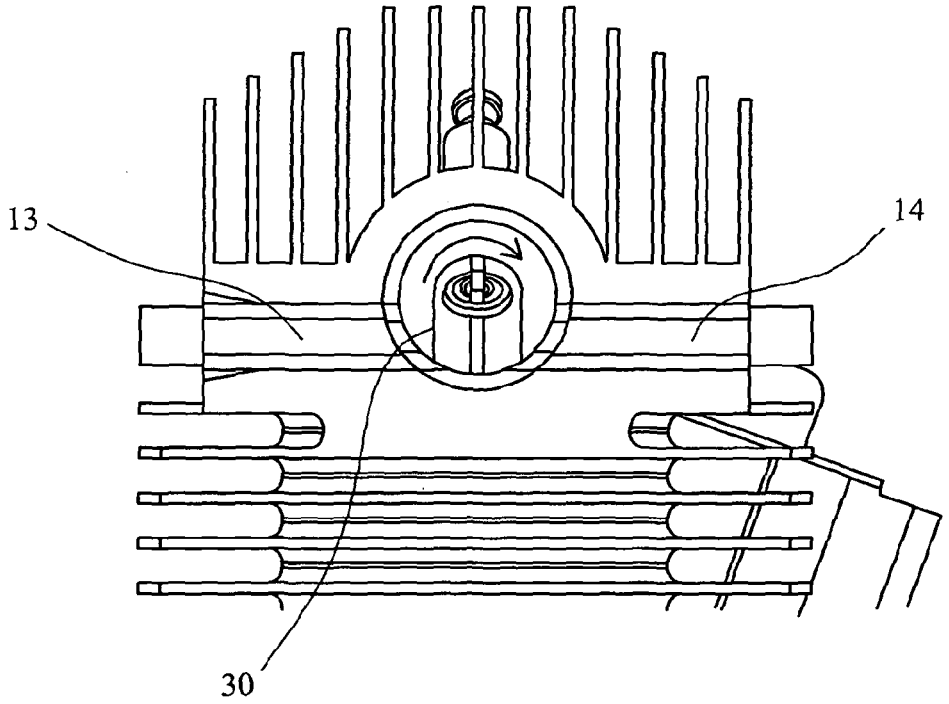

Referring now to additionally to FIGS. 3A, 3B, 4A, 4B and 4C, there is shown alternative embodiments of the rotary valve, in which like parts bear reference numerals. In the embodiment of FIGS. 3A and 4C, the leak path B is closed by a spring ring 32, in the manner of a piston ring which lies between the shoulder 25 on the valve body 11 and the inner race 24 of the bearing. The light pressure of the O ring holding the spring ring 32 lightly between the valve and the bearing allows the spring ring 32 to move outwards to engage with the inner diameter of the valve housing 8. The spring ring 32 is sprung outwards to form a seal between the outer radial surface of the ring 32 and the inner radial surface of the valve housing 8.

Under maximum pressure in the combustion chamber, combustion pressure generates a compression force on the valve which is transmitted through the spring ring 32 to the bearing arrangement to urge the planar surfaces of the spring ring 32 into firmer contact with both the valve shoulder 25 and inner race 24 thereby reducing leakage at this point.

Referring now to FIGS. 3B and 4A, there is shown an alternative embodiment of a ring seal design to close leak path B. In this case the spring ring 32 lies within a groove 11*a* in the valve body 11. Its planar surface furthest from the combustion chamber abuts the adjacent planar surface of the groove 11*a*. It is held in this position by a wave spring 32*a* or similar device fitted within the groove 11*a* between the planar surface of the ring nearest the combustion chamber and the adjacent planar surface of the groove 11*a*. This provides the initial sealing contact between the planar surfaces. The ring 32 is also lightly sprung outwards to provide the initial sealing force between the outer radial surface of the ring 30 and the inner radial surface of the valve housing 8. Under maximum pressure in the combustion chamber combustion gases enter the space between the ring 32 and valve body behind the ring to urge both the planar and radial sealing surfaces into firmer contact thereby reducing leakage at this point.

In both of the above embodiments the leak path A is sealed by an annular part-cylindrical sleeve 33 which is located on the exterior of the valve body 11, as shown in FIGS. 4A, 4B and 4C. The sleeve 33 has an opening 34 which coincides with the port 12 in the valve body and is located relative to the valve body by a peg 35 which prevents rotation of the ring and axial movement relative to the valve but enables the sleeve 33 to be able to float and expand radially. The part cylindrical sleeve 33 is biased resiliently outwards and operates in a similar manner to a conventional piston ring of a conventional internal combustion engine in which the combustion gases get behind the ring and urge it into contact with the cylinder wall. In the present embodiment, the gases get between the sleeve 33 and the valve body 11 so as to urge the ring outwardly in the direction to seal the path A. When the cylinder gas pressure drops, the sealing forces are correspondingly reduced, the spring action of the sleeve providing a low contact pressure between the rotating valve and the valve housing to form an initial seal. In one form the sleeve has a slightly larger internal diameter than the diameter of the valve to provide an initial gap for the gases to enter more easily.

Figure 7:
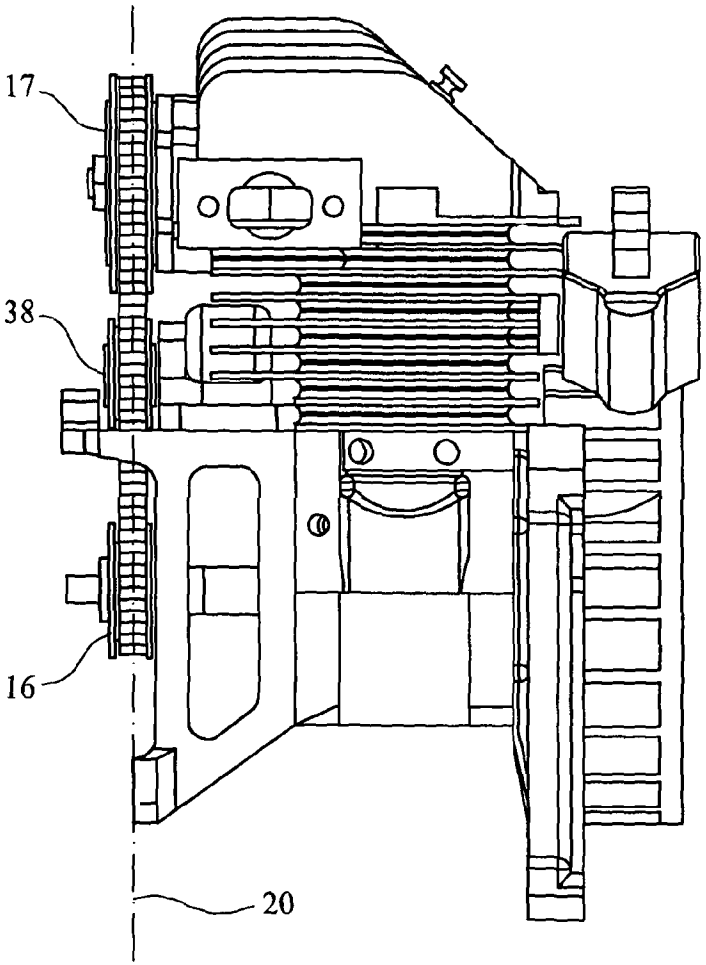
FIG. 7 shows a side view of the arrangement shown in FIG. 6.

Referring now to FIGS. 7A and 7B, there is shown, respectively, an end view and a side view of the belt drive arrangement incorporating a contra rotating balance shaft where like parts have like references. The belt drive arrangement consists of a toothed drive pulley 17A on the crankshaft and a toothed driven pulley driving the rotary valve, the drive being transmitted through a flat toothed belt 19A. The drive arrangement includes a further balance shaft toothed pulley 38 driven by the toothed belt 19A. The toothed belt has teeth on both its inner and outer surfaces to transmit the drive. To achieve contra rotation the balance shaft is driven by the teeth on the opposite side of the belt to those that are engaged with the crankshaft pulley. In FIG. 7, it can be seen that all three pulleys lie in the common radial plane 20.

Figure 8A:
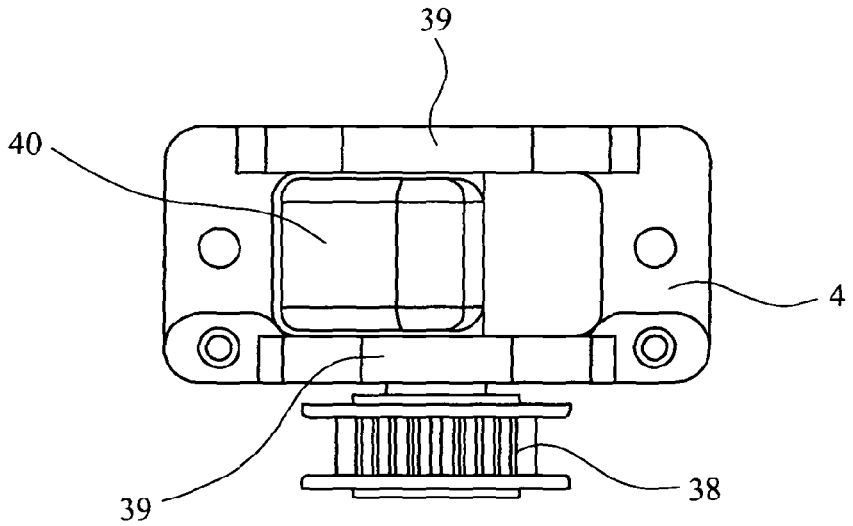
FIGS. 8A, 8B and 8C shows a detail of the balance shaft illustrated in FIGS. 6 and 7.
Figure 8B:
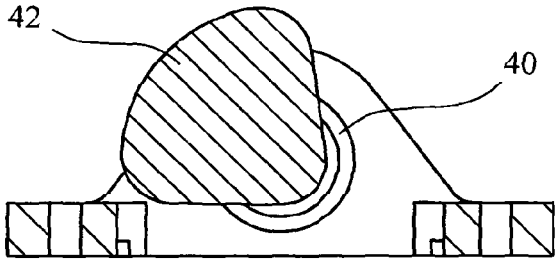
Figure 8C:
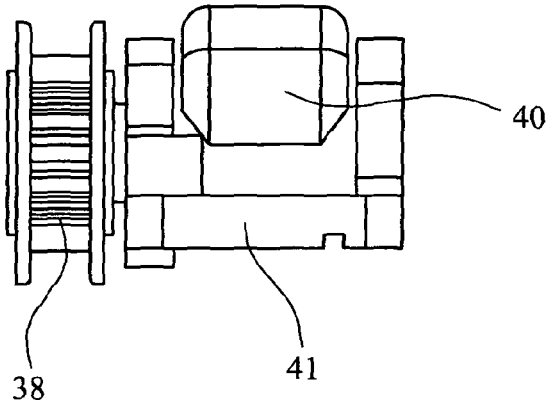

Referring now to FIGS. 8A, 8B, and 8C, there is shown details of the contra rotating balance shaft. The balance shaft 40 is rotatably mounted in bearings 39 in a frame 41 adapted to be bolted to the main housing of the engine, the shaft having an offset balance weight 42 designed to give the desired balancing characteristics. The balance shaft drive pulley 38 is secured to the shaft 40 on the exterior of the frame 41.

Figure 9B:
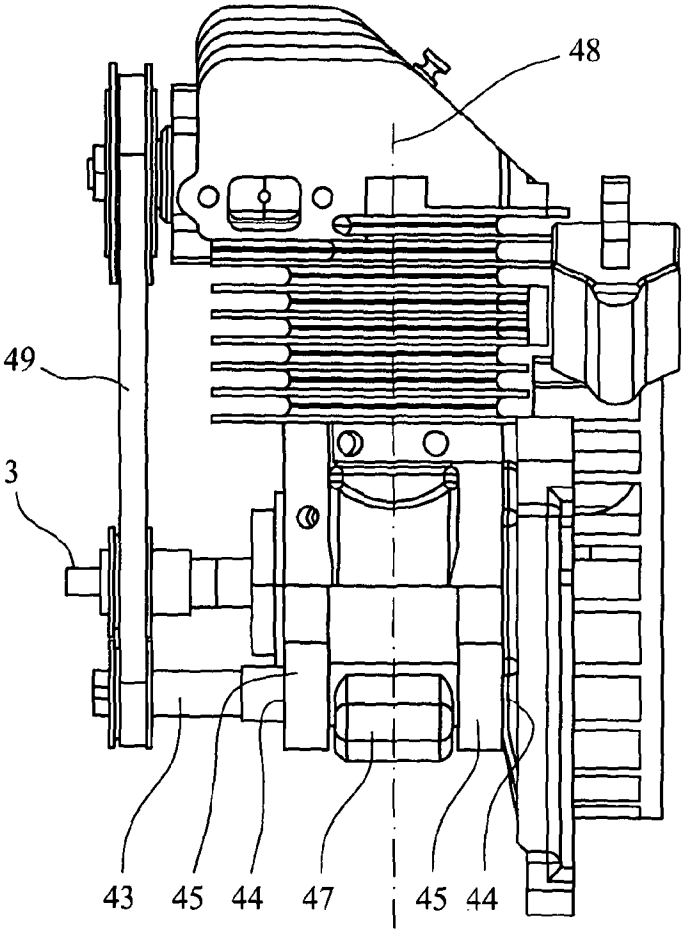
FIGS. 9A and 9B show an embodiment having twin contra-rotating balance shafts.
Figure 9A:
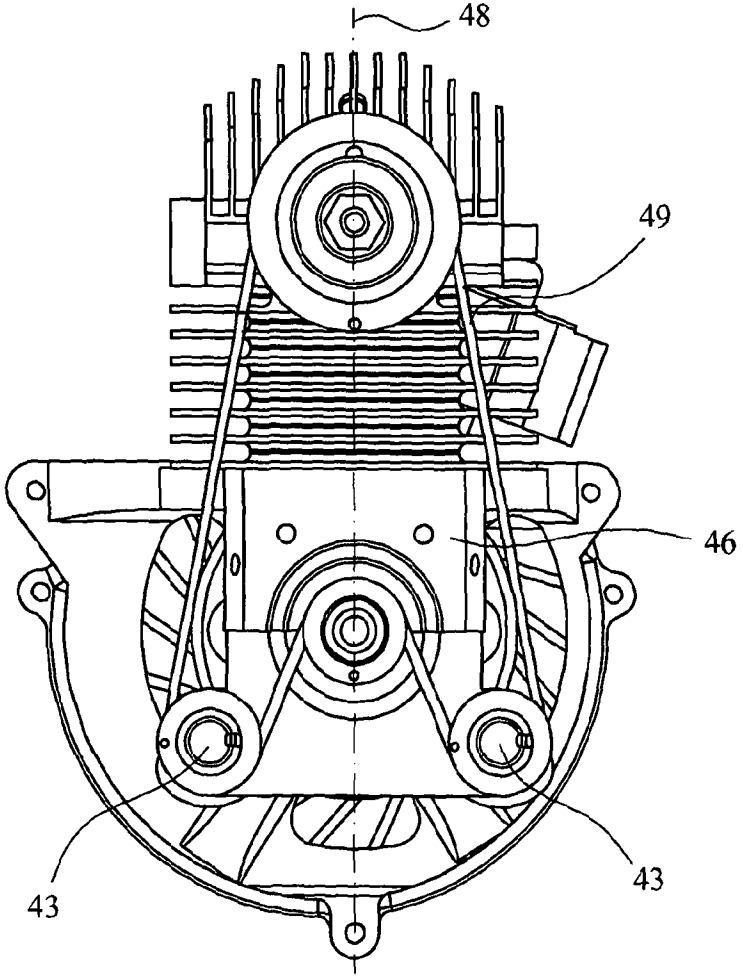
Figure 10B:
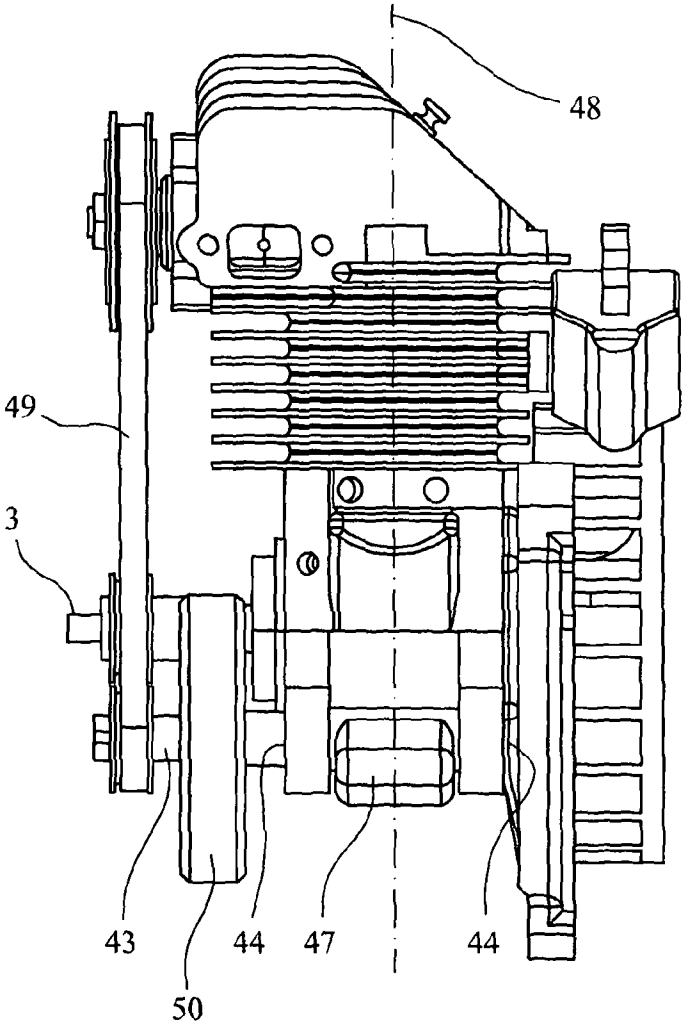
FIGS. 10A and 10B show a further embodiment having twin contra-rotating balance shafts each carrying a contra rotating flywheel.
Figure 10A:
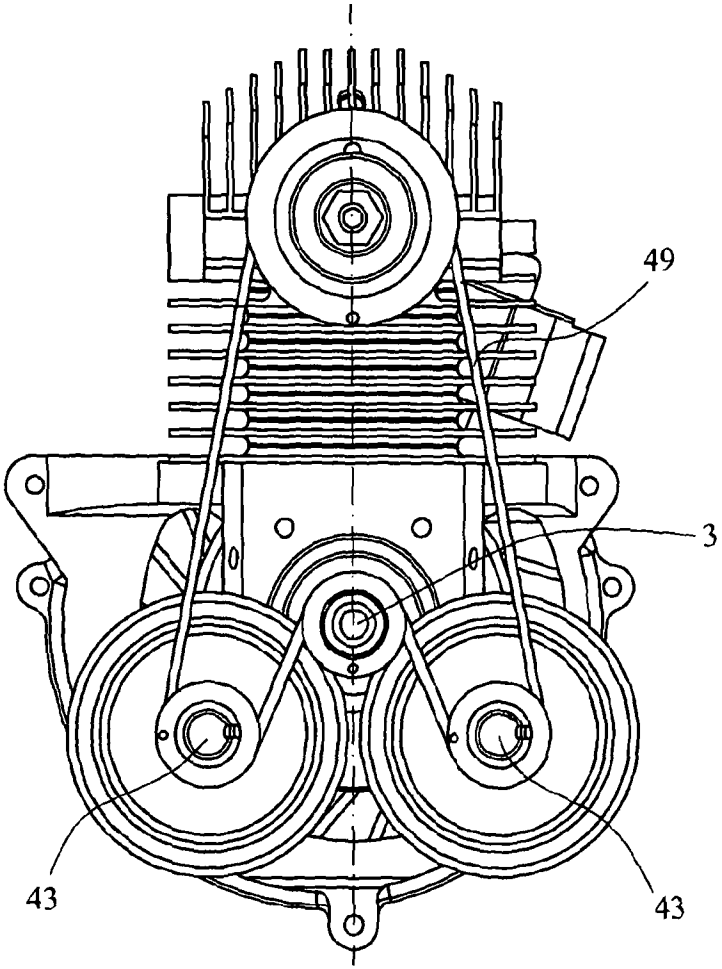

Referring now to FIGS. 9A and 9B, there is shown details of an engine with twin contra rotating balance shafts. The balance shafts 43 are each rotatably mounted in bearings 44 in lugs 45 extending from the crankcase 46, the shafts 43 each having an offset balance weight 47 designed to give the desired counter-balancing characteristics. The balance shafts 43 are arranged either side of the crankshaft 3, substantially equidistant from the centreline 48 of the cylinder 2 and driven by a double sided toothed belt 49 The centre of mass of each offset balance weight 47 is aligned with the centreline of the cylinder 2. This arrangement enables the combined centre of mass of the two offset balance weights 47 to be substantially aligned with the axis 48 of the cylinder, said arrangement ensuring that the net force generated by the balance shafts 47 is substantially in line with the axis 48 of the cylinder, and therefore in line with the reciprocating forces generated by the piston, thereby minimising vibration at the engine mounting points Referring now to FIGS. 10A and 10B, there is shown a further embodiment of the engine with the twin contra rotating balance shafts which incorporates on each shaft a contra rotating flywheel 50 to also reduce torque recoil. The total rotational inertia of the two contra rotating flywheels 50 is substantially the same as that of the engine crank train and flywheel, thereby minimising torque recoil forces at the engine mounting points.

Figure 6:
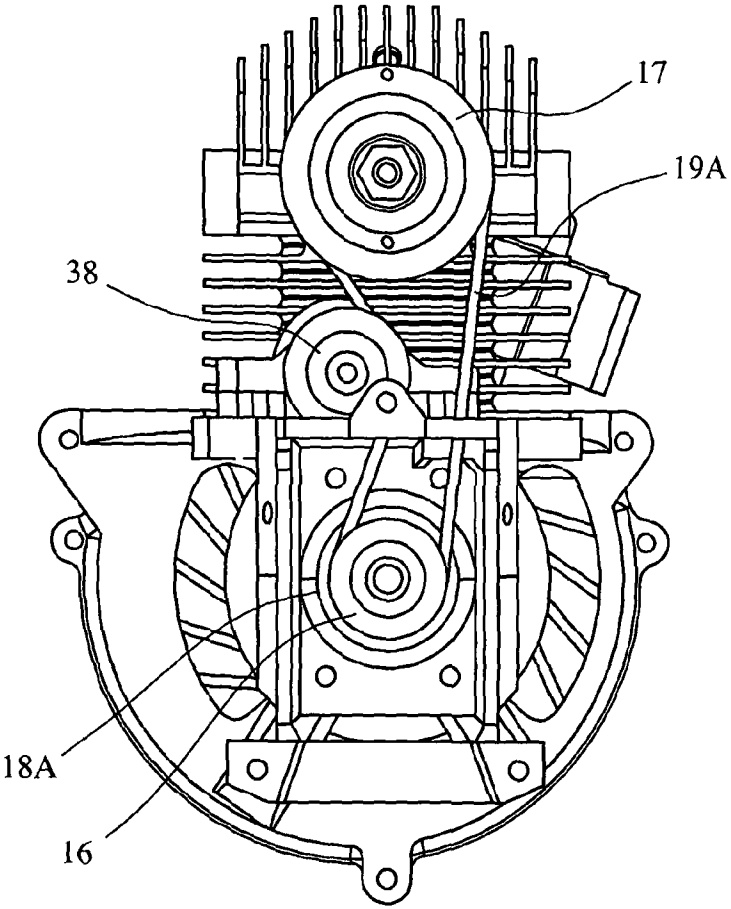
FIG. 6 shows a front view of a drive arrangement for an engine having a contra rotating balance shaft.

It will be understood that a suitable contra rotating flywheel could also be incorporated within the single balance shaft configuration shown in FIGS. 6 and 7.

Although described as a single cylinder engine, it will be understood that the invention is equally applicable to multi cylinder engines which may be of in-line, Vee or horizontally opposed configuration. Furthermore, although described as a spark ignition engine the invention is equally applicable to a compression ignition engine.

The invention claimed is:

1. A rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the valve is mounted in a bearing arrangement which restrains the valve from movement in the axial direction but permits movement in the radial direction, wherein the bearing arrangement comprises a single race ball bearing, wherein the valve body is coaxial with a drive shaft of smaller diameter, the drive shaft extending through the inner race of the bearing with a clearance therebetween to enable the valve to move in the radial direction, the shoulder formed between the valve body and the shaft abutting the inner race to restrain axial movement of the valve when subjected to positive combustion pressure, wherein the shaft has a flange overlapping the side face of the inner bearing race away from the valve body, the flange restraining movement of the valve towards the cylinder, there being a clearance between the flange and the said inner race such that the valve is not clamped between the inner race but is able to float radially within the inner race.

2. A rotary valve internal combustion engine according to claim 1, wherein a resilient means is located between the flange and the said side face of the inner race to bias the valve against movement towards the cylinder during periods of negative pressure in the cylinder, whilst still permitting the valve to float radially.

3. A rotary valve internal combustion engine according to claim 2, wherein the resilient means comprises an O-ring.

4. A rotary valve internal combustion engine having a piston connected to a crankshaft and reciprocatable in a cylinder, a combustion chamber being defined in part by the piston, and a rotary valve rotatable in a valve housing fixed relative to the cylinder, the rotary valve having a valve body containing a volume defining, in part, the combustion chamber and further having in a wall part thereof a port giving, during rotation of the valve, fluid communication successively to and from the combustion chamber via inlet and exhaust ports in the valve housing, wherein the valve body has an annular part cylindrical sealing sleeve secured to the body for rotation therewith but movable radially relative to the body and being arranged such that combustion gases enter between the body and the sleeve to urge the sleeve into engagement with the valve housing, the sleeve being resiliently biased outwardly into the housing to provide an initial seal, the inner diameter of the sleeve being larger than the external diameter of the valve body to form a gap between the sleeve and the valve body, wherein the sleeve has a gap substantially the same size as the port in the valve body, to which the gap is aligned, the sleeve extending over substantially the entire length of the valve body so that the sleeve completely covers the inlet and exhaust ports during the compression and combustion strokes.

5. A rotary valve internal combustion engine according to claim 4, wherein the valve body has an annular sealing ring located between the valve port and the bearing arrangement which restrains the valve from movement in the axial direction, wherein the sealing ring is biased outwardly into engagement with the valve housing, one planar surface of the sealing ring abutting a shoulder of the valve body, an opposite planar surface of the sealing ring abutting a side face of the inner bearing, the arrangement being such that combustion pressure urges the planar surfaces into contact with each other during periods of high combustion pressure.

6. A rotary valve internal combustion engine according to claim 5, wherein the sealing ring lies in a peripheral groove in the outer radial surface of the valve body, wherein the sealing ring is arranged such that combustion gases enter the space between the planar surface of the ring nearest to the combustion chamber and the adjacent planar surface of the groove and the space between the inner radial surface of the ring and the outer radial surface of the groove to urge the planar surface of the ring furthest from the combustion chamber into engagement with the adjacent planar surface of the groove and to urge the outer radial surface of the ring into engagement with the inner radial surface of the valve housing, wherein a spring is located between the planar surface of the sealing ring nearest to the combustion chamber and the adjacent planar surface of the groove to urge the planar face of the sealing ring furthest from the combustion chamber against the adjacent planar surface of the groove and to generate an initial sealing force which is augmented by the combustion chamber pressure force during periods of high compression.

* * * * *